United States Patent [19]

Norota

[11] Patent Number: 4,751,760

[45] Date of Patent: Jun. 21, 1988

[54] WHOLLY AROMATIC POLYAMIDE FIBERS AND COMPOSITE FIBERS, PROCESS FOR PRODUCTION THEREOF AND USE THEREOF

[75] Inventor: Susumu Norota, Ibaraki, Japan

[73] Assignee: Teijin Limited, Osaka, Japan

[21] Appl. No.: 854,839

[22] Filed: Apr. 23, 1986

[30] Foreign Application Priority Data

Apr. 23, 1985 [JP] Japan ..... 60-85376
Jan. 24, 1986 [JP] Japan ..... 61-12089

[51] Int. Cl.[4] ..... A46B 9/04; D02G 3/00

[52] U.S. Cl. ..... 15/159 A; 428/364; 428/374; 428/397

[58] Field of Search ..... 428/364, 373, 374, 397; 15/159 R, 159 A; 528/348; 525/432; 524/142

[56] References Cited

U.S. PATENT DOCUMENTS

| | | | |
|---|---|---|---|
| 3,751,546 | 8/1973 | Horoldt | 528/348 X |
| 3,850,889 | 11/1974 | McKinney | 528/348 X |
| 4,196,118 | 4/1980 | Fujie et al. | 524/142 |
| 4,245,066 | 1/1981 | Nakagawa et al. | 525/432 |
| 4,278,779 | 7/1981 | Nakagawa et al. | 525/432 |
| 4,399,084 | 8/1983 | Sagawa et al. | 425/72 S |
| 4,526,735 | 7/1985 | Norota et al. | 264/27 |

FOREIGN PATENT DOCUMENTS

| | | | |
|---|---|---|---|
| 900009 | 7/1962 | United Kingdom | 428/364 |

*Primary Examiner*—Lorraine T. Kendell
*Attorney, Agent, or Firm*—Wenderoth, Lind & Ponack

[57] ABSTRACT

A stretchable wholly aromatic polyamide fiber which (A) is composed of a wholly aromatic polyamide containing at least 85 mole %, based on the entire recurring units, of m-phenylene isophthalamide units as a main component, (B) does not substantially contain an aprotic polar solvent, (C) has an average denier size of 50 to 50,000, (D) when stretched to two times at the glass transition temperature of the wholly aromatic polyamide, has a maximum heat shrinkage under a fixed load of at least 30%.

A stretched wholly aromatic polyamide fiber which has the same properties with (A), (B) and (C), and (D) has a maximum heat shrinkage under a fixed load of at least 20% and (E) is substantially amorphous.

The present invention provides a stretchable and stretched wholly aromatic polyamide composite fiber containing inorganic pieces and processes for preparing the above fibers.

8 Claims, 3 Drawing Sheets

WHOLLY AROMATIC POLYAMIDE FIBERS AND COMPOSITE FIBERS, PROCESS FOR PRODUCTION THEREOF AND USE THEREOF

BACKGROUND AND PRIOR ART

This invention relates to fibers and composite fibers, of wholly aromatic polyamides, a process for production thereof, and uses of these fibers.

Wholly aromatic polyamides of the poly(m-phenylene isophthalamide) type (to be sometimes abbreviated "PMIA" hereinafter) have superior heat resistance and fire retardancy because they have a glass transition point of about 280° C., a melting point and a heat decomposition point each of about 420° C. and a limiting oxygen index of-about 30. Furthermore, they have moderate rigidity. For this reason, these aromatic polyamides have been produced and marketed in quantities as fibers under registered trademarks Nomex® (Du Pont), Conex® (Teijin Limited), etc. These commercial fibers are known to be produced by, for example, the wet method or dry method described in Japanese patent Publication Nos. 870/1963, 50219/1972 and 38612/1971 and U.S. Pat. No. 3,360,598, or the dry jet-wet spinning method described in Japanese patent publication No. 815/1967, and in any case, their production relies on these "solution spinning" methods. The primary reason for it is that since PMIA has a high melting point which is close to its heat decomposition point, its melt-spinning is very difficult.

The high cost of production owing to the low productivity and the need for investment in solvent recovery or neutralization equipment may be cited as the disadvantage of the solution spinning method. It also has difficulties that cannot be ignored and are required to be overcome.

Firstly, large-denier fibers (bristles) having a size of at least 30 denier, particularly at least 50 denier, are very difficult to produce by the solution spinning method. In the solvent removing step in the solution spinning process, the solvent at the outer skin portion of the fibers generally dissipates preferentially and the skin portion begins to be coagulated first. Hence, as the fibers increase in denier size, the solvent removal of the core portion is gradually retarded. Thus, to produce large-denier fibers, the solvent removing step must be performed for an extraordinarily long period of time, and it is difficult in practice to produce such fibers. In addition, a great difference arises in microstructure between the surface and the inside of the resulting fibers owing to a difference in solvent removal, and the fibers assume an extreme skin-core structure and becomes almost useless. In fact, as far as the present inventor knows, wholly aromatic polyamide fibers having a size of more than 50 denier are not commercially available.

A second point is that the organic solvent and the inorganic salts as a dissolving aid used in solution spinning remain in the final fibers. Aprotic polar solvents such as dimethylformamide, dimethylacetamide or N-methylpyrrolidone are used as the solvent in the solution spinning of PMIA, and halides of metals of Group I or II of the periodic table, such as lithium chloride and calcium chloride, are used as the inorganic salts. Analysis clearly shows that such solvents and inorganic salts remain in the final product. Particularly, the fact that the solvent remains in an amount of nearly 1% causes concern not only about its adverse effects on the heat resistance of the final product, but also about the use of the final product in medical and food applications. To the best of the knowledge of the present inventor, it is difficult or substantially impossible in practice to obtain PMIA fibers completly free from the residual solvent by the solution spinning methods such as the wet or dry method. The aforesaid commercial fibers have a size of about 10 denier at the largest. But since the present invention is directed to fibers having a size of at least 50 denier which are classed as bristles, the difficulty of obtaining solvent-free fibers further increases.

A third problem of the solution spinning method is that as the denier size of a fiber produced by this method increases, its cross-sectional surface tends to become irregular. There are various uses of the bristles, but for use as a material for advanced industrial fields, the circularity of the fiber cross section is frequently regarded as an important factor. Hence, the irregular shape of the fiber cross-section is a serious problem.

The present inventor, together with coworkers, previously proposed a method of producing bristles by melt-spinning a wholly aromatic polyamide (U.S. Pat. No. 4,399,084 and European Laid-Open Patent Publication No. 0047091). This method comprises instantaneously melting a substantially solid wholly aromatic polyamide on an electrically heated thin mesh spinneret, extruding the molten polyamide through many fine openings of the mesh spinneret before it substantially loses fiber-forming ability, and immediately then solidifying the filaments by cooling while forcibly taking them up.

This method is innovative in the melt spinning of wholly aromaic polyamides, and gives wholly aromatic polyamide fibers free from a spinning solvent since it does not use the solvent. Later investigations of the present inventor have revealed some disadvantages of this method.

(1) Since the wholly aromatic polyamide is melted even instantaneously, the resulting unstretched filaments are cross-linked to such a degree that the molecular chains are difficult to orient.

(2) Since the melt-spinning is carried out using the mesh spinneret, it is difficult to stretch the filaments at such a high ratio that there is a great change in the cross-sectional area of the fibers in their longitudinal direction (therefore, when the filaments are stretched at a temperature in the vicinity of their glass transition point, the tension increases and the filaments frequently undergo breakage at those parts whose cross-sectional area is small).

(3) Since the spinning mesh spinnert, many filaments gather one on top of another as a bundle, and it is difficult to maintain a uniform dry heat temperature within a short period of time on those filaments which are located inside the bundle.

The present inventor also proposed a method of melt-spinning a wholly aromatic polyamide in which the fiber-forming polymer is fed in the form of a shaped mass to a die equipped with a spinneret having numerous closely spaced small openings such as a mesh spinneret and then spun (see U.S. Pat. No. 4,526,735 and European Laid-Open patent publication No. 0086112). The characteristic feature of this method is to feed the fiber-forming polymer to the die after it is converted into a shaped mass. The above patent documents fail to describe a stretched filaments obtained by stretching and orienting the resulting unstretched filaments.

It is an object of this invention therefore to provide novel fibers of a wholly aromatic polyamide containing at least 85 mole %, based on the entire recurring units, of m-phenylene isophthalamide units as a main component.

Another object of this invention is to provide novel wholly aromatic polyamide fibers which do not substantially contain an aprotic polar solvent, or in other words, are quite different from wholly aromatic polyamide fibers obtained by solution-spinning of a solution of a wholly aromatic polyamide in an aprotic polar solvent.

Another object of this invention is to provide wholly aromatic polyamide fibers which do not substantially contain an aprotic polar solvent and are substantially amorphous.

Another object of this invention is to provide stretchable wholly aromatic polyamide fibers which clearly show the glass transition temperature of a wholly aromatic polyamide, and when stretched at the glass transition temperature, show a very high heat shrinkage.

Another object of this invention is to provide stretched wholly aromatic polyamide fibers which are oriented but are substantially amorphous and are not crystallized.

Another object of this invention is to provide wholly aromatic polyamide fibers which have a small cross-sectional area variation in the longitudinal direction of the fibers, a substantially circular cross section, and superior toughness, bending fatigue resistance and elastic recovery.

Another object of this invention is to provide wholly aromatic polyamide fibers having a size of at least 50 denier which are very difficult to produce, or cannot substantially be produced, by solution spinning.

Another object of this invention is to provide unstretched wholly aromatic polyamide fibers which unlike conventional unstretched wholly aromatic polyamide fibers produced by solution spinning, cannot substantially be stretched in hot water.

Another object of this invention is to provide wholly aromatic polyamide fibers which unlike conventional unstretched wholly aromatic polyamide fibers produced by solution spinning or stretched products thereof, can be substantially crystallized only at temperatures near the crystallization temperature of the wholly aromatic polyamide itself.

Another object of this invention is to provide a process for producing the aforesaid wholly aromatic polyamide fibers of the invention.

Another object of this invention is to provide a brush having excellent fatigue resistance at high temperatures comprising the wholly aromatic polyamide fibers of the invention as bristles.

Further objects of this invention along with its advantages will become apparent from the following description.

BRIEF SUMMARY OF THE INVENTION

According to this invention, these objects and advantages of the invention are firstly achieved by a stretchable wholly aromatic polyamide fiber which (A) is composed of a wholly aromatic polyamide containing at least 85 mole %, based on the entire recurring units, of m-phenylene isophthalamide units as a main component, (B) does not substantially contain an aprotic polar solvent, (C) has an average denier size of 50 to 50,000, (D) when stretched to two times at the glass transition temperature of the wholly aromatic polyamide, has a maximum heat shrinkage under a fixed load, defined by the following formula (I), of at least 30%, $$S^{o}(\%) = \frac{L_o^{o} - L_p^{o}}{L_o^{o}} \times 100 \qquad \text{(I)}$$

wherein S° is the maximum heat shrinkage (%) under a fixed load, $L_o$° is the length of the sample fiber stretched as above a at room temperature, and $L_p$° is the length of the stretched sample fiber measured when its shrinkage which occurs when it is placed under a fixed load of 5 mg per denier and heated from room temperature at a rate of 2° C./min. is maximum, and (E) is substantially amorphous.

According to this invention, the stretchable wholly aromatic polyamide fiber is produced by a process which comprises (1) preparing homogeneous shaped articles composed of a wholly aromatic polyamide containing at least 95 mole %, based on the entire recurring units, of m-phenylene isophthalamide units as a main component, each of the shaped articles having a porosity of not more than 5% and such a shape that it has a predetermined uniform section in at least one direction;

(2) forcibly stuffing the shaped articles into a spinning area having a pre-heating zone, a softening zone and a heat keeping zone from the pre-heating zone while the form of each shaped article is substantially retained, the pre-heating zone having such a passage that each shaped article can move therethrough in a direction perpendicular to its predetermined uniform section while its form is substantially retained, (3) moving each shaped article to the other end of the pre-heating zone while it is pre-heated in the preheating zone at a pre-heating temperature not exceeding a temperature 20° C. higher than the glass transition temperature (Tg, °C.) of the wholly aromatic polyamide (Tg+20), (4) forcing the pre-heated shaped articles into the softening zone having at its terminal portion in the advancing direction of the shaped articles at least one attenuating passage formed of an orifice;

(5) rapidly heating the shaped articles kept at the pre-heating temperature (Tp, °C.) until it attains a softening temperature satisfying the following expression $$Tg+40^{\circ}\ C. \leqq Ts \leqq Tm-20^{\circ}\ C.$$

wherein Tg (°C.) is the glass transition temperature of the wholly aromatic polyamide, Tm (°C.) is the melting point of the wholly aromatic polyamide, and Ts (°C.) is the softening temperature of the wholly aromatic polyamide, within the attenuating passage of the softening zone and extruding the shaped article from the orifice into the heat keeping zone to form a filament of the wholly aromatic polyamides, and (6) maintaining the vicinity of the extrusion opening of the orifice at a temperature Tk (°C.) satisfying the following expression $$Tg \leqq Tk \leqq Tm-20^{\circ}\ C.$$

wherein Tg and Tm are as defined above and TK (°C.) is the temperature of the vicinity of the extrusion opening of the orifice, and taking up the filament of the wholly aromatic polyamide while placing it under a draft.

DETAILED DESCRIPTION

Figure 1:
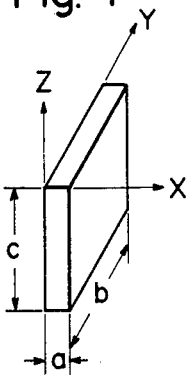
FIG. 1 is a perspective view of a rectangular or plate-like article which is one embodiment of the shaped articles of wholly aromatic polyamide used in this invention.

The process of this invention will be described in detail below.

The wholly aromatic polyamide used in step (1) in the process of this invention is a homo- or co-polyamide containing at least 85 mole %, based on the entire recurring units, of m-phenylene isophthalamide units (to be referred to as the poly(m-phenylene isophthalamide) type wholly aromatic polyamide or PMIA.

PMIA is obtained by polycondensing m-phenylenediamine with or without another aromatic diamine as an amine component and isophthalic acid with or without another aromatic dicarboxylic acid or its derivative as an acid component. PMIA used in the process of this invention is preferably produced, for example, by the interfacial polymerization method described in Japanese patent publication No. 10863/1972 because this method easily gives PMIA which is in the form of porous aggregated particles very suitable for the formation of the shaped article used as a material for the production of the thick fibers of this invention and does not substantially contain aprotic polar solvent. Whether PMIA in the form of porous aggregated particles contains an aprotic polar solvent such as tetrahydrofuran, N,N-dimethylformamide, N,N-dimethylacetamide, tetramethylurea, N-methylpyrrolidone, dimethyl sulfoxide and hexamethyl phosphoramide basically depends upon the method of polycondensation and the method of purification, but in practice, analytical methods such as gas chromatography will give this knowledge. For example, in the method of interfacial polymerization for producing PMIA in the form of porous aggregated particles suitable as a material for the fibers of this invention, tetrahydrofuran is preferably used as a solvent for m-phenylenediamine and isophthaloyl chloride, but tetrahydrofuran having a low boiling point (66° C.) is not found to be present in the final polymer particles obtained by washing the interfacial polymerization product with water and drying it (a gas chromatographic analysis shows that less than 1 ppm of tetrahydrofuran remains). Since the fibers of this invention can be produced without using a solvent at all in the production process, there is no possibility of the fibers themselves containing a solvent unless the starting polymer contains it. However, substantially solvent-free fibers can be obtained by the process of this invention even if the starting PMIA particles contain some amount of a solvent having a low boiling point such as tetrahydrofuran.

The PMIA fibers of this invention are characterized by being substantially free from an aprotic polar solvent as stated above. The "substantial freedom from an aprotic polar solvent", as used herein, should be understood to mean that the amount of the solvent in the PMIA fibers which is detected by an analyzing method such as gas chromatography is not more than 0.01% by weight, preferably not more than 0.001% by weight.

Investigations of the present inventors have shown that for medical and food applications, the content of the solvent is desirably not more than 0.001% by weight, but from the standpoint of obtaining amorphous orientation by stretching the fibers themselves, the content of the residual solvent should be limited to 0.01% by weight or below. In many cases, solvents remaining in PMIA fibers produced by the solution spinning method are high-boiling solvents such as N,N-dimethylacetamide and N-methylpyrrolidone. An accurate analysis shows that even a fabric of the PMIA fibers which is dyed and finished contains about 0.3% of the residual solvent, and ordinary fibers contain it in an amount of 1 to 5%.

Figure 2:
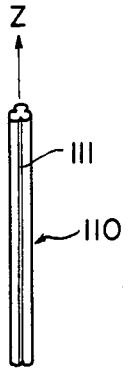
FIG. 2 is a perspective view of a circular article which is one embodiment of the above shaped articles.

The homogeneous shaped article composed of the wholly aromatic polyamide as a main component can be produced, for example, by compression-molding the wholly aromatic polyamide particles. The homogeneous shaped article has a porosity of not more than 5% and such a shape that it has a predetermined uniform section in at least one direction. As shown in FIGS. 1 and 2 of the accompanying drawings, the shaped article has a uniform section in at least one direction (the Z direction in the drawings).

The porosity ($\epsilon$, %), as used herein, is defined by the following formula $$\epsilon = \frac{Va - Vr}{Va} \times 100(\%)$$

wherein Va is the apparent volume of the shaped article and Vr is the true volume of the PMIA component and a second component constituting the shaped article.

For the production of the fibers of this invention, the shaped article should have a porosity of not more than 5%, preferably not more than 1%. If its porosity exceeds 5%, much gas gets into the fibers during the production process and the mechanical properties of he fibers are reduced. Thus, it is difficult to produce the desired fibers.

The compression molding conditions for the shaped article vary depending upon the shape of the shaped article. For example, the compression molding is preferably carried out at the glass transition temperature of PMIA or higher temperature but not exceeding its melting point under a pressure of 20 to 100 kg/cm$^2$, especially 50 to 100 kg/cm$^2$.

The uniform section of the shaped article may be rectangular as shown in FIG. 1 or circular as shown in FIG. 2, or may be in any other shape such as a triangular, hexagonal or elliptical. It is necessary however that the sectional shape should be substantially uniform in the longitudinal direction. Except in special cases, this shaped article has a definite length. Hence, the shapes and areas of the uniform sections of two or more shaped articles used as the starting materials should be substantially the same.

Figure 3:
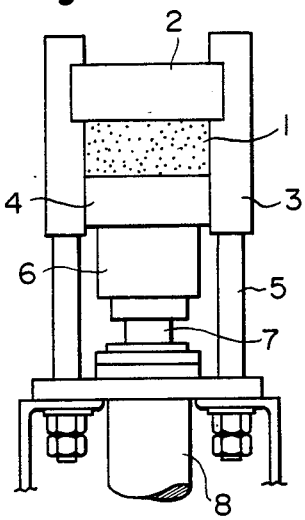
FIG. 3 is a schematic view of one embodiment of compression molding machines for producing the rectangular article shown in FIG. 1.

For example, plate-like shaped articles as shown in FIG. 1 can be produced by a compression molding machine as shown in FIG. 3 in the following manner.

A PMIA powder as a starting material is fed into the compression molding machine having an open top portion with the sliding of an upper heating plate 2 in the direction extending toward the back of the sheet in FIG. 3, preferably after it is pre-heated to about 200° C. Then, the upper heating plate 2 is caused to slide toward the sheet surface to close the machine. By actuating the piston of a hydraulic cylinder 8 upwardly, the pressure is gradually elevated. A heater is built in all of the upper heating plate 2, a heating frame 3 and a lower heating plate 4 which define the outside wall of the compression molding machine, and the temperature of the molding machine is adjusted to 300° to 350° C. When as a result of gradual pressure elevation, the pressure reaches 1 to 20 kg/cm$^2$, preferably 3 to 10 kg/cm$^2$, the actuation of the piston is temporarily suspended. On stoppage of the operation of the piston, the compression pressure begins to decrease. When it decreases to 1/10, preferably substantially to 0, the piston is again actuated to start pressure elevation.

This temporary suspension at a compression pressure of 1 to 20 kg/cm$^2$ is very important for heat conduction to the inside of the powdery PMIA, uniform containment of moisture in the inside of the PMIA and removal of air and excessive moisture. This suspension must be effected at least once, preferably 2 times, more preferably 3 to 7 times. When the pressure becomes substantially zero in the first suspension, the pressure elevation is again started and when the pressure reaches 1 to 20 kg/cm$^2$, suspension is effected for the second time. When the pressure reaches sustantially zero, the temperature elevation is started again. After the pressure elevation and lowering operation is over, the pressure is finally elevated to at least 30 kg/cm$^2$. If required, this state is maintained for a certain predetermined period of time to make the density of the shaped article uniform before compression molding is completed. In the molding machine shown in FIG. 3, the shaped article is taken out by sliding the upper heating plate 2 in the direction extending to the back of the sheet to open the top of the machine, and actuating the piston 7 upwardly to move the shaped article out of the machine. Since the adhesion of the shaped article to the inside wall of the molding machine makes it difficult to withdraw the shaped article from the machine, it is desirable to take measures for mold releasing by, for example, coating the inside wall of the molding machine with a fluorine resin.

In step (2) of the process of this invention, the shaped article is fed to a spinning area. The spinning area has a pre-heating zone, a softening zone and a heat keeping zone. The pre-heating zone has such a passage that the shaped article can move therethrough while its form is substantially retained in a direction perpendicular to its predetermined section. The shaped article is forcibly stuffed into the pre-heating zone while its form is substantially retained. The shaped article stuffed into the pre-heating zone is moved to the other end of the pre-heating zone in step (3), and during this time, it is gradually pre-heated to a temperature not exceeding a temperature 20° C. higher than the glass transition temperature (Tg, °C.) of the wholly aromatic polyamide forming the shaped article. The pre-heated shaped article is forced into the softening zone in step (4). The softening zone has attenuating passages formed of orifices at its terminal portion in the advancing direction of the shaped article. The shaped article forced into the softening zone and pre-heated to the preheating temperature (Tp, °C.) is rapidly heated to a softening temperature (Ts, °C.) which is between a temperature 40° C. higher than the glass transition temperature (Tg, °C.) of the wholly aromatic polyamide and a temperature 20° C. lower than the melting point (Tm, °C.) of the wholly aromatic polyamide, and extruded from the orifices into the heat keeping zone to form filaments of the wholly aromatic polyamides in step (5). In step (6), the filaments are taken up under a draft from the heat keeping zone in which the vicinity of the extrusion openings is kept at a temperature (Tk, °C.) between the glass transition temperature (Tg) of the wholly aromatic polyamide and a temperature 20° C. lower than its melting point. perature 20

The process of this invention comprising the steps (1) to (6) will be more specifically described below with reference to FIGS. 4 and 5 of the accompanying drawings.

Figure 4:
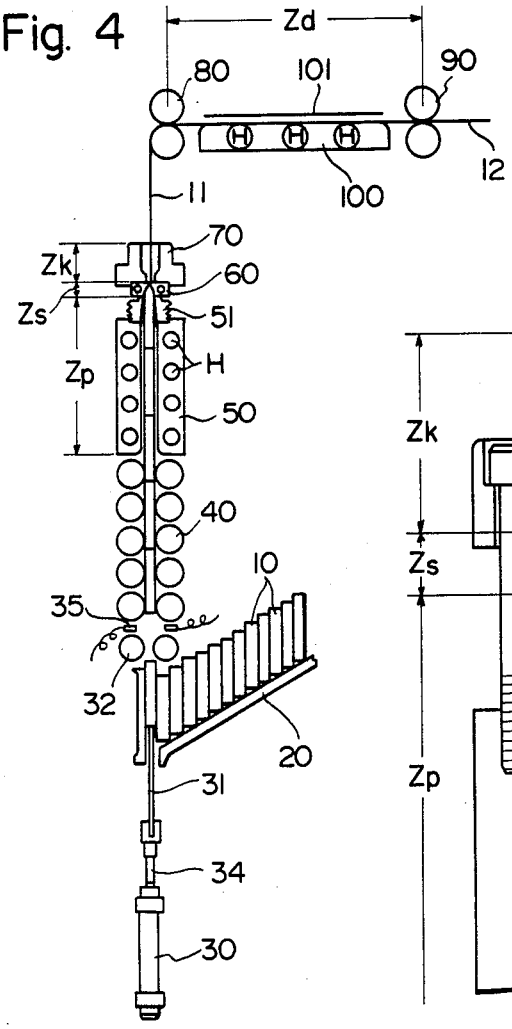
FIG. 4 is a schematic view of an apparatus for carrying out the process of this invention.

In FIG. 4, a plurality of shaped PMIA articles 10 are laid on a sliding plate 20 with the perpendicular direction (Z direction) of their predetermined unifrom sections directed upwardly. The first of the shaped articles 10 is moved upwardly by an upwardly moving plate 30 attached to an air cylinder 30, further moved upwardly by delivery rollers 32, and fed to stuffing rollers 40. The operation of the air cylinder for successively moving the shaped articles 10 upwardly is controlled by a photoelectric tube 33. Specifically, when the shaped article 10 is sent by the delivery rollers 32 and shuts off the light of the photoelectric tube, the piston 34 of the air cylinder 30 is actuated downwardly to lower the upward moving plate 31. With it, the shaped articles on the sliding plate, as aligned, move downwardly by a distance corresponding to one shaped article, and one shaped article is placed on the upwardly moving plate 31. On the other hand, when the shaped article delivered by the delivery rollers 32 is moved upwardly by the stuffing rollers 40 and no longer shuts off the light of the photoelectric tube, the piston 34 is moved upwardly, and one shaped article is again fed to the delivery rollers 32. By repeating the foregoing operation, the shaped articles can be incessantly fed to the stuffing rollers 40. To bring the newly fed shaped article always into close contact with the shaped article fed to the stuffing rollers 40, it is important that the delivery rollers 32 should be rotated under a torque at a higher speed than the stuffing rollers 40 until the newly fed shaped article is held by the stuffing rollers 40, catches up the preceding shaped article already held by the stuffing rollers 40 and comes into close contact with it, and after close contact, the delivery rollers 32 should be rotated under a torque at a speed corresponding to the speed of the stuffing rollers 40.

The shaped article 10 moving at a fixed velocity while being held firmly by the stuffing rollers 40 (five sets of a pair of rollers in FIG. 4) is then fed into the preheating zone (Zp).

It is necessary that the pre-heating zone should have such a passage that the shaped article 10 moves therethrough while its form is substantially retained in the perpendicular direction (Z direction) of the fixed uniform section. The passage in the apparatus shown in FIG. 4 is formed of a first pre-heating box 50 and a second preheating box 51 having a symmetrical sectional space having a size slightly larger than the uniform section (a×b) of the shaped article. Heaters H are embedded in the wall of the first pre-heating box 50, and the temperature of the passage is accurately controlled. A cooling fin is attached to the outside wall of the second pre-heating box 51. In the pre-heating zone formed of the pre-heating boxes 50 and 51, the PMIA shaped article is moved to the terminal portion of the pre-heating zone (Zp) while it is gradually pre-heated to a preheating temperature (Tp, °C.) not exceeding a temperature 20° C. higher than the glass transition point (Tg, °C.) of PMIA.

The pre-heating temperature (Tp, °C.) should be controlled by measuring the temperature of the inside of the PMIA shaped article. It can, however, be controlled indirectly by making the length of the pre-heating zone, namely the length of the pre-heating boxes, sufficiently long, and adjusting the temperature of the passage to Tp.

The preferred pre-heating temperature (Tp) should be adjusted to a maximum temperature at which the section of the shaped article in the pre-heating zone does not substantially vary even under a high stuffing pressure.

If Tp is too high, the shaped article in the pre-heating zone is softened by heat, and its sectional shape varies greatly. Thus, the shaped article will stick to the inside wall of the pre-heating boxes or buckle and clog up the passage. Conversely, when Tp is too low, the temperature should be raised too rapidly in the next softening zone, and non-uniformity in temperature elevation occurs undesirably.

The suitable ranges of the pre-heating tenmperature Tp and the softening temperature Ts in the next step have been found in accordance with this invention by carefully studying the various behaviors of PMIA fibers substantially free from an aprotic polar solvent incident to thermal changes. For example, the glass transition point (Tg) and melting point (Tm) can be learned by differential thermal analysis (DTA) or differential scanning calorimetry (DSC). Glass transition points or melting points obtained by DTA or DSC may vary slightly depending upon the measuring conditions. In the present invention, a DSC curve is drawn by using THERMOFLEX DSC-8230 (made by Rigaku Denki Co., Ltd.) and elevating the temperature of 2 mg of a sample in nitrogen at a rate of 2° C./min. From the curve in the glass transition temperature region (in the vicinity of 280° C.), Tg+ and Tg− are read, and a middle point between them is defined as Tg. The endothermic peak in the melting temperature region (in the vicinity of 420° C.) is defined as Tm. It has also been found from this DSC curve that the crystallization peak (Tc) of PMIA exists in the vicinity of 360° C.

Fibers obtained by the conventional solution spinning method, whether unstretched or stretched, contain aprotic polar solvents. Thermal analysis does not reveal any definite Tg, Tm and Tc. The DSC curves of these fibers quite differ in shape from that of the fibers obtained in this invention and being subsantially free from an aprotic polar solvent.

The heat decomposition point of PMIA can be determined by thermogravimetric analysis, and is found to be nearly the same as Tm. A detailed analysis of the TGA curve of PMIA in air at a temperature elevation rate of 10° C./min. shows that at such a slow temperature elevating rate, a gentle weight decrease tendency is observed at about 380° C. or above. It is found undesirable therefore to maintain this temperature for a long period of time.

The use of a dynamic viscoelasticity measuring device or a thermomechanical analysis device makes it possible to learn the responses of the dynamical properties of PMIA incident to its thermal changes. The results of the measurement show that at about (Tg−10° C.), the reduction of the modulus of elasicity begins to increase.

Based on the above results of this basic study, the present inventor has conducted a stuffing experiment at varying pre-heating temperatures, Tp, for the PMIA shaped article. It has consequently been found that when the pre-heating temperature exceeds Tg+20° C., the shaped article is compressed and deformed within the pre-heating zone even under the minimum pressure required for extruding PMIA (about 20 kg/cm$^2$) and may increase in sectional area, buckle, or stick to the inside wall of the passage of the pre-heating zone to fail to move smoothly through the passage.

In setting the pre-heating temperature, it is necessary to consider the pressure required for extruding the softened PMIA from orifices. This pressure varies depending upon various factors such as the structure of the softening zone and the softening temperature. Experiments conducted by the present inventor show that this pressure is in the range of 20 kg/cm$^2$ to 1000 kg/cm$^2$, and the required pressure can be obtained by increasing the number of the stuffing rollers 40. Since the basic role of the shaped article in the pre-heating zone is, as it were, a plunger for extruding PMIA softened in the softening zone, it is important that the shaped article should substantially retain its form. Accordingly, at the time of extruding it under a high pressure, the temperature should be below that temperature at which the reduction of the modulus of elasticity begins to increase (preferably Tg−10° C.). However, if the pre-heating temperature is too low, it is difficult to elevate the temperature in the softening zone and therefore to increase the extruding speed. The preferred pre-heating temperature is (Tg−30° C.) to (Tg−10° C.).

The length Zp of the pre-heating zone in this invention is one sufficient for elevating the temperature of the inside of the shaped article to the aforesaid pre-heating temperature. The sufficient length Zp can be set by actually measuring it by introducing a temperature measuring device into the inside of the shaped article, or by theoretically calculating heat conduction to obtain the theoretical value and multiplying it by a safety coefficient. Thus, if the temperature of the shaped article moving at a fixed speed within the pre-heating zone is set at the temperature Tp of the pre-heating boxes, the shaped article attains Tp on its way through the pre-heating zone and moves to the terminal portion of the pre-heating zone while maintaining this temperature. The terminal portion of the pre-heating zone denotes that terminal portion of the pre-heating zone which measures about 10 mm and leads to the inlet of the next softening zone. Ideally, it is desirable to maintain the pre-heating temperature Tp at a point not exceeding Tg+20° C. to the end of the pre-heating zone. But it may exceed the aforesaid limit slightly in the about 10 mm portion leading to the inlet of the softening zone because of heat conduction. However, measures should be taken so that the pre-heating temperature Tp does not exceed (Tg+20)°C. to a point as immediately before the softening zone as possible.

Figure 5:
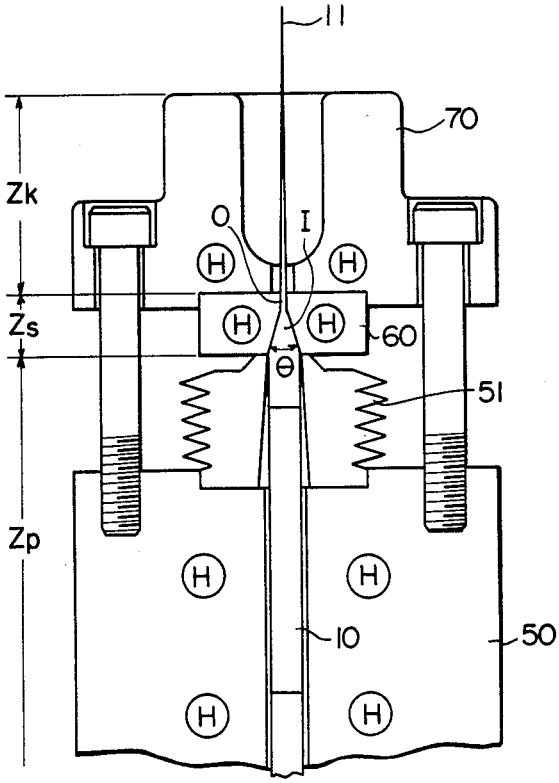
FIG. 5 is an enlarged view of the softening zone and its vicinity of the apparatus of FIG. 4.

In the embodiment shown in FIGS. 4 and 5, the first pre-heating box 50 is controlled to a temperature 20 to 40° C. lower than Tg by the heaters H, and the second pre-heating box 51 is thermally balanced by heat conduction from the softening zone (spinneret) 60, heat radiation by the fin and heat conduction to the first pre-heating box 50. Thus, the average temperature of the pre-heating zone is kept at Tg or in its vicinity. According to the process of this invention, there is a temperature difference of about 100° C. between the softening zone (spinneret) and the preheating zone. Hence, heat transfer from the softening zone to the pre-heating zone should be minimized. One measure against it is that to reduce heat conduction by convection, the softening zone is arranged over the pre-heating zone. Another measure is to minimize the area of contact between the second pre-heating box 51 and the spinneret 60 constituting the softening zone.

The shaped article which has thus been pre-heated to the pre-heating temperature Tp is forced into the softening zone 60 having a length Zs in FIGS. 4 and 5. The softening zone is a softening and extruding section with a length of at least 3 mm having attenuating passages constructed of orifices at at least its terminal portion.

The softening zone serves firstly to heat the preheated PMIA shaped article rapidly to a uniform softening temperature Ts; secondly to convert many discontinuous PMIA shaped articles into a continuous softened article by imparting fine shear deformation or elongation deformation to the inside of the softened PMIA shaped articles and bringing the molecules into intimate contact with each other, and thirdly to extrude the continuous softened article uniformly from the orifice.

Various contrivances are required in order that the softening zone acts effectively in the manner described above. One specific example is shown in FIG. 5 which is an enlarged view of the softening zone and its vicinity shown in FIG. 4. In the pre-heating zone, the shaped article pre-heated to Tp in the preheating zone is forced into the softening zone having attenuating passages consisting as the spinnert 60 of an inverted V-shaped inlet portion I and a plurality of orifice portions O closely spaced from each other in a direction perpendicular to the sheet surface of FIG. 5. Cartridge heaters H having a circular cross-section are embedded in the spinneret 60 and supply heat necessary for rapidly heating the forced shaped article to a softening temperature (Tg+40° C.≦Ts≦Tm−20° C.). In this simple softening zone, the inlet angle $\theta$ and the length Zs of the softening zone are of much importance to the performance of the second and third functions mentioned above. It has been found in accordance with this invention, the suitable inlet angle is $20° < \theta < 60°$, and the suitable length Zs of the softening zone is at least 3 mm, preferably 5 to 20 mm. If Zs is shorter than 3 mm, the adjoining portions of the shaped articlees are broken by drafting upon being extruded from the orifices.

The degree of attenuation, $\alpha$, of the attenuating passages of the softening zone, defined by the following formula, is important for smooth narrowing.

$$\alpha = \frac{\text{Cross-sectional area of an orifice outlet} \times \text{Number of orifices}}{\text{cross-sectional area of the shaped article } (axb) \text{ in a direction perpendicular to the advancing direction of the shaped article}}$$

If the degree of attenuation is too large, the PMIA cannot attain uniform Ts at its inside, and the adhesion of the adjoining portions of the shaped articles with each other becomes weak so that filament breakage tends to occur. If, on the other hand, the degree of attenuation is too small, the back pressure in the passage becomes too high. Consequently, extrusion of the shaped articles from the orifices becomes unstable, and the coefficient of sectional variation of the filament, CV, increases. The preferred range of the degree of attenuation is $0.01 \leqq \alpha \leqq 0.3$, and the more preferred range is $0.02 \leqq \alpha \leqq 0.1$.

The diameter of the orifices may be preset according to the denier size of the filaments to be produced. For production of filaments having a size of 50 to 50,000 denier, the orifice diameter is in the range of 0.3 to 5.0 mm.

The softening temperature Ts of PMIA should be preset at Tg+40° C.≦Ts≦Tm−20° C. as can be clearly sen from the various behaviors of PMIA incident to its thermal changes. For the production of PMIA filaments which are uniform and have excellent properties, the preferred range is Tg+50° C.≦Ts≦Tm−50° C. The softening temperature Ts of PMIA is the temperature of that portion of PMIA which has attained a nearly uniform temperature in the softening zone, and is, for example, the temperature measured by introducing a temperature measuring device into the end portion of the inlet portion in the embodiment shown in FIG. 5. Desirably, Ts is controlled by the heaters H of the spinneret. Where it is difficult to introduce the temperature measuring device, Ts of PMIA can be controlled indirectly by measuring the temperature of the spinneret. Since, however, the corresponding relation of the temperature of the spinneret and the temperature of PMIA changes depending upon the preheating temperature Tp of the PMIA shaped article, the size of the shaped article, the stuffing speed and the shape of the attenuating passage, it is naturally necessary to examine the corresponding relation in advance.

PMIA softened in the softening zone is extruded into the heat keeping zone having a length Zk surrounded by a thermally insulating wall 70 from the orifices, and taken up by take-up rollers 80 (FIG. 4) under a draft. The draft ratio is preferably at least 1.2, more preferably at least 1.5, especially preferably at least 2.0, and above all 2 to 20. The draft ratio Dr is defined by the following formula.

$$Dr = \frac{\text{Take-up speed}}{\text{Extrusion speed}}$$

In the heat keeping zone, the temperature (Tk °C.) of the vicinity of the extrusion opening of each of the orifices should be maintained at Tg≦Tk≦(Tm−20)°C. The temperature of the vicinity of the extrusion opening of each orifice, as referred to herein, means the temperature of a space in a region 3 mm to 10 mm apart from the orifice extrusion opening. If Tk is lower than the glass transition point Tg of PMIA, non-uniformity in exrusion may occur owing to the cooling of the surface of the orifice plate. Furthermore, the draft cannot be increasd owing to rapid cooling, an nonuniformity of the cross-sectional area of the fibers tends to occur. This may result in a failure to obtain PMIA fibers having a coefficient of sectional variations (CV) of not more than 0.05. If Tk exceeds T−20° C., the aromatic polyamide tends to decompose thermally in the heat keeping zone, and fibers having the properties intended by this invention cannot be obtained. The preferred range of Tk is Tg+50° C.≦Tk≦Tm−50° C. and is desirably set at a temperature almost equal to the softening temperature Ts in the softening zone.

The heating effect of the heat keeping zone kept at this temperature is to increase greatly the draftability of PMIA extruded at the softening temperature Ts.

The length (Zk) of the heat keeping zone is at least 10 mm, preferably 30 mm to 100 mm. If temperature control is exercised rigorously, it may permissibly exceed 100 mm. Where Ak is long, it is necessary, for example, to decrease the temperature gradually from the surface (at Tk) of the orifice plate toward the outlet of the heat keeping zone.

The effect of drafting in the heat keeping zone is to attenuate, making uniform and to molecularly orient the fibers. Since in the process of this invention, PMIA is extruded at the softening temperature which is much lower than the melting point of PMIA, the viscosity of the polymer during extrusion is not high. The molecules of the polymer are oriented by flowing within the spinneret, and also after it has left the spinneret, some molecular orientation occurs at a relatively low draft ratio.

The filaments 11 to be taken up after passage through the heat keeping zone should be fully cooled before they reach the take-up rollers 80. For this purpose, positive cooling means for air cooling or water cooling, for example, may be provided as required. If the filaments are held by the take-up rollers before cooling, their cross-sectional shape may change.

The process of this invention described above thus gives stretchable wholly aromatic polyamide fibers having the requirements (A), (B), (C), (D) and (E). The stretchable wholly aromatic polyamide fibers of this invention are particularly characterized by being able to be very easily stretched because they do not substantially contain an aprotic polar solvent and have some molecular orientation for taking-up under a draft.

Stretching of these fibers in this invention is carried out by introducing the filaments obtained from the heat keeping zone, i.e., the stretchable wholly aromatic polyamide fibers, into a stretching zone kept at a temperature satisfying the following expression $$Tg-20^\circ\ C. \leqq Td \leqq Tg+40^\circ\ C.$$

wherein Tg (°C.) is the glass transition temperature of the wholly aromatic polyamide, and Td (°C.) is the stretching temperature, and subjecting them to dry stretching.

The stretching step in accordance with this invention will be described with reference to FIG. 4.

The filaments which have left the take-up rollers 80 are directly introduced into the stretching zone Zd. In the embodiment shown in FIG. 4, the stretching zone Zd is comprised of a pair of take-up rollers 80, a pair of stretch rollers 90 and a hot stretching plate 100 and a cover 101 therefor interposed between the roller pairs.

In the stretching step in accordance with this invention, the stretching temperature Td is set between the temperature (Tg−20)° C. and the temperature (Tg+40)° C. When Td is lower than the lower limit specified, it is difficult to stretch filaments containing no aprotic polar solvent. If the temperature is higher than the upper limit specified, the wholly aromatic polyamide becomes liable to flow, and during the stretching operation, the filaments may break by their own weight, or crystallization rather than orientation proceeds in the filaments. The preferred Td (°C.) range is represented by Tg−10)°C.≦Td≦(Tg+20)°C. the stretching step is usually at least 1.2, preferably at least 1.5, and especially preferably 2.0 to 4.0.

In the embodiment shown in FIG. 4, the temperature of the stretching plate 100 heated by the cartridge heaters H is preset at (Tg−20)°C. to (Tg+40)°C. and the temperature of the filaments is substantially adjusted to the temperature of the plate during the stretching operation. It is important that in the stretching operation, the filaments should attain the desired stretching temperature as early as possible. Since the filaments spun from the spinneret in FIG. 4 are aligned, they conveniently make uniform contact with the stretching plate. The stretching zone may also be of a non-contacting box-type zone instead of using the hot plate. In any case, the filaments should be heated uniformly to the stretching temperature, and the length of the heating zone should be sufficiently large.

It is very beneficial to perform production of unstretched filaments and production of stretched filaments in an uninterrapted manner as shown in FIG. 4 when a wholly aromatic polyamide substantially free from an aprotic polar organic solvent is used as the starting material. The unstretchd filaments absorb moisture on standing in the air and soon attain a moisture content of about 7%. If the unstreched filaments that have absorbed moisture are heated to the stretching temperature without prior drying, foaming occurs in the filaments to make their stretching difficult or even impossible.

The stretched wholly aromatic polyamide fiber produced by the above stretching step is characterized by (A') being composed of a wholly aromatic polyamide containing at least 85 mole %, based on the entire recurring units, of m-phenylene isophthalamide units as a main component, (B') not substantially containing an aprotic polar solvent, (C') having an average denier size of 20 to 20,000, (D') having a maximum heat shrinkage under a fixed load, defined by the following formula (II), of at least 20%, $$S(\%) = \frac{L_o - L_p}{L_o} \times 100 \qquad \text{(II)}$$

wherein S is the maximum heat shrinkage (%) under a fixed load, $L_o$ is the length of the sample fiber stretched as above at room temperature, and $L_p$ is the length of the stretched sample fiber measured when its shrinkage which occurs when it is placed under a fixed load of 5 mg per denier and heated from room temperature at a rate of 2° C./min. is maximum, and (E') being substantially amorphous.

Now, the production of a monofilament of this invention from the rod-like shaped article shown in FIG. 2 of a wholly aromatic polyamide will be described with reference to the apparatus shown in FIG. 6.

Figure 6:
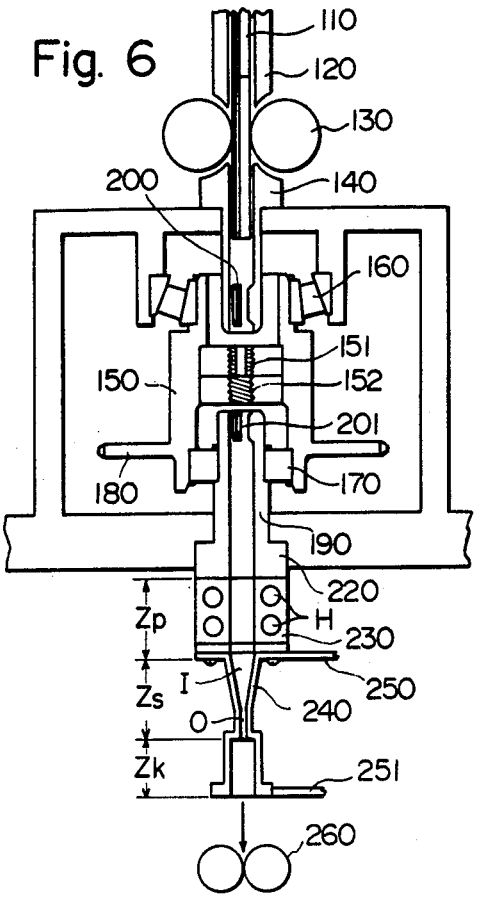
FIG. 6 is a schematic view of another apparatus for carrying out the process of this invention.

With reference to FIG. 6, rod-like shaped articles 110 as shown in FIG. 2 are aligned in series in a hopper 120, and are successively fed to a front fixed cylinder 140 by being held on supply rollers 130. The supply rollers 130 serve to cause the rod-like shaped articles 110 to bite into the internal threaded portion of a forcibly rotated cylinder 150 to be described, and are not essential when one continuous rod-like shaped article is used.

The inside diameter of the front fixed cylinder 140 should be larger than the outside diameter of each rod-like shaped article 110. Three protrusions 200 are provided inside the front fixed cylinder 140 to prevent rotation of the rod-like shaped articlees. The protrusions 200 are received by grooves 111 of the rod-like shaped article to prevent rotation.

The rod-like shaped articles 110 which have passed through the front fixed cylinder 140 reach a rotating cylinder 150 provided coaxially immediately rearwardly of the front fixed cyclinder. The rotating cylinder 150 is supported by an upper bearing 160 and a lower bearing 170 and forcibly rotated by a motor (not shown) connected to a sprocket 180 fixed to the rotating cylinder 150. The inside of the rotating cylinder 150 has an internal threaded structure having a diameter smaller than the inside diameter of the front fixed cylinder 140. In the present embodiment, the internal threaded structure is divided into two portions. A first internal threaded structural member 151 (inside of the front end portion of the rotaing cylinder) assumes the structure of a threading die which is basically the same as a tool for providing an external thread in an ordinary metallic round rod.

A second internal threaded structural member 152 is formed next to the first internal threaded structural member 151. The second internal threaded structural member 152 needs not to be of the threading die structure, but assumes an ordinary internal threaded structure having the same specification as the first internal threaded structural member 151.

When the rod-like shaped article whose rotation is prevented by the fixed cylinder 140 advances into the rotating cylinder 150 having the aforesaid internal threaded structure, it advances downwardly in FIG. 6 while it is being forcibly threaded by the cutting blade of the first internal threaded structure member 151 to form an external threaded structure. Soon, it reaches the internal threaded structure portion and thereafter advances while its external threaded structure is in tight engagement with the second internal threaded structure portion.

In FIG. 6, the rod-like shaped articles metered from the rotating cylinder 150 reach a rear fixed cylinder 190 provided coaxially immediately rearwardly of the rotating cylinder 150. The rear fixed cylinder 190 may have substantially the same structure as the front fixed cylinder 140. Specifically, the same protrusions 201 as in the front fixed cylinder 140 are provided inside the rear fixed cylinder 190 to prevent rotation of the rod-like shaped article fed from the rotating cylinder 150. The shape and positions of the protrusions 201 should be substantially the same.

The protrusions 201 are essential when the rod-like shaped articles are a discontinuous. If the trailing end of one rod-like shaped article has gone past the protrusions in the front fixed cylinder 140, the leading end of this shaped article should be fixed tightly by the protrusions 201 in the rear fixed cylinder 190. Otherwise, the rod-like shaped article rotates incident to the rotation of the rotating cylilnder 150 and quite fails to advance. It will be understood from this that the length of the rod-like shaped article should be larger than the distance from the rear end of each protrusion 200 in the front cylilnder to the front end of each protrusion 201 in the rear cylinder.

The rod-like shaped article which has passeed through the rear fixed cylinder 190 is introduced into a preheating cylinder 230 including a heater H forming a preheating zone via a heat insulating ring 220. As in the case of the plate-like shaped article shown in FIG. 1, the shaped article is pre-heated to a preheating temperature Tp represented by $Tp \leqq (Tg+20)$°C., preferably $(Tg-30)$°C. to $(Tg-10)$°C.

The rod-like shaped article pre-heated to Tp is then forced into the softening zone having a length Zs in FIG. 6. The softening zone is composed of an inlet portion 1 shown by Zs in FIG. 6 and an orifice portion O and is constructed of an electrially heated nozzle 240 to which the next heat keeping zone (Zk) is connected. The electrically heated nozzle 240 is made of stainless steel, nickel, chromium, etc., and terminals 250 and 251 from a current passing device (not shown) constructed of a fixed transformer, a variable transformer and a current control device are connected to the inlet of the nozzle, i.e. the inlet of the softening zone Zs, and the outlet of the nozzle, i.e. the outlet of the heat keeping zone Zk. By passing an electric currrent, the Joule's heat can be freely produced. Since the amounts of heat generated in various parts of the nozzle differ according to the electrical resistance of the nozzle wall, i.e. the shape of the nozzle wall, the nozzle wall should be designed accurately so that the amount of heat necessary and sufficient for elevating the temperature of PMIA forced into the softening zone to the desired softening temperature Ts from Tp will be generated. The temperature of PMIA in the softening zone is detected by a temperature measuring device 260 and fed back to the current passing device.

The advantage of using the electrically heated nozzle is that by decreasing the thickness of the nozzle wall and keeping the heat of the entire nozzle, only an energy required to raise the temperature of PMIA from Tp to Ts is supplied from Joule's heat. Consequently, dissipation of the excess heat to the outside is reduced, and the temperatures of the pre-heating zone and the softening zone are easy to control independently.

PMIA extruded from the orifice opening while undergoing shear deformation in the softening zone formed in the electrically heated nozzle is taken up at a draft ratio of at least 1.2 by take-up rollers 260 via the heat keeping zone Zk at the forward end portion of the same nozzle.

The process of this invention described above thus gives the stretchable wholly aromatic polyamide fibers of this invention having the requirements (A), (B), (C), (D) and (E). When these stretchable fibers are subjected to the same stretching step as described hereinabove, the stretched wholly aromatic polyamide fibers of this invention having the aforesaid requirements (A'), (B'), (C'), (D') and (E') can be obtained. These fibers are in the form of monofilaments.

The stretchable wholly aromatic polyamide fibers (PMIA fibers) of this invention will now be described more specifically.

Firstly, the stretchable PMIA fibers of this invention are composed of a wholly aromatic polyamide containing at least 85 mole %, based on the entire recurring units, of m-phenylene isophthalamide as a main component [requirement (A)] as described hereinabove with regard to the starting PMIA. Secondly, these PMIA fibers do not substantially contain an aprotic polar solvent [requirement (B)].

These PMIA fibers are characterized by the fact that the amount of solvent detected therefrom by analytical methods such as gas chromatography is not more than 0.01% by weight, preferably not more than 0.001% by weight.

Investigations of the present inventor show that in medical and food applications, the content of solvent in the PMIA fibers is desirably not more than 0.001% by weight, but in view of addverse effects on the viscoelastic properties of the PMIA fibers themselves, the content of the residual solvent should be adjusted to not more than 0.01% by weight. Many of the solvents remaining in the PMIA fibers produced by the solution method are high-boiling solvents such as N,N-dimethylacetamide and N-methylpyrrolidone. By accurate analysis, a dyed and finished fabric is found to contain about 0.3% of the residual solvent. Even ordinary fibers are found to contain 1 to 5% of the residual solvent. It has been found that the residual solvent in an amount of about 1% exerts adverse effects on the viscodynamic properties of PMIA fibers.

A dynamic testing method is used as means for generally evaluating the viscoelastic property of a polymeric substance over a long time scale and a broad temperature region. Especially for a fibrous material, a method is employed which comprises imparting static elastic strain in advance to a sample, imparting forced vibratory strain of a fixed frequency on this basis, and measuring a complex elastic modulus. The viscoelasticity measuring device used in this invention is Spectrometer VES-F made by Iwamoto Works, Co., Ltd. under the following measuring conditions.

Initial load: 0.25 gr/de
Sample length: 3.0 cm
Dynamic strain: +0.1%
Frequency: 10 Hz
Rate of temperature elevation: 1.6° C./min.

By the above dynamic elasticity measuring device, dynamic modulus E', dynamic loss E'' and loss tangent tan δ can be obtained at given temperatures.

The PMIA fibers of this invention are used suitably in fields requiring heat resistance, for example, as bristles of heat-resistant brushes. In applications in such fields requiring heat resistance, elastic recovery and fatigue resistance over a temperature range and a long period of time. These properties can be evaluated by dynamic loss E'' or loss tangent tan δ as is well known generally. Particularly, in evaluating the same polymer, the loss tangent tan $\delta = E''/E'$, which is the ratio of the dynamic loss E'' to the dynamic modulus E', is reliable with reduced measuring errors, and can fully evaluate the elastic recovery and fatigue resistance of the PMIA fibers of the invention.

It has been found that when the tan δ values of PMIA fibers having a size of 1 to 40 denier and the PMIA fibers of this invention are measured, there is a very clear difference between the two. Stretched PMIA fibers obtained by the solution method and containing about 1% of N,N-dimethylacetamide or N-methylpyrrolidone have a tan δ at 30° C. of about 0.01, and even the unstretched PMIA fibers have a tan δ at 30° C. of about 0.005. On the other hand, the PMIA fibers of this invention have a tan δ at 30° C. of about 0.003.

The clear difference is observed in tan δ values at a temperature in the vicinity of Tg. It is thought that the peak of the main dispersion of tan δ appears in the vicinity of Tg (270°–280° C.). In the case of PMIA fibers obtained by the solution method, the temperature corresponding to the rising of the peak shift toward the lower temperature side. To show this quantitatively, the tan δ values at 260° C. will be compared. The stretched PMIA fibers obtained by the solution method have a tan δ at 260° C. of about 0.04, and the unstretched PMIA fibers obtained by the solution method rapidly flow at 230° C., and the tan δ at 260° C. cannot be measured (the tan δ at 230° C. is 0.05). In contrast, the PMIA fibers of this invention have a tan δ at 260° C. of about 0.02.

A detailed study by the present inventor has led to the knowledge that the aprotic polar solvent remaining even in a tiny amount in PMIA exerts a great effect on the tan δ value of PMIA. However, the PMIA fibers of this invention having such a tan δ value as above are not obtained simply because the starting PMIA does not contain an aprotic polar solvent. To obtain PMIA fibers having such a tan δ value, the process of this invention should be carried out under the aforesaid controlled conditions.

Preferably, the stretchable PMIA fibers of this invention have a loss tangent at 30° C. [ tan δ (30)] and a loss tangent at 260° C. [ tan δ (260)] satisfying the following formulae:

$$\tan \delta(30) \leqq 0.005$$

$$\tan \delta(260) \leqq 0.035$$

Investigations of the present inventor have shown that the tan δ values of PMIA fibers produced by methods other than the process of this invention described above do not satisfy the above formulae. For example, they have a tan δ (30) of not more than 0.005 but a tan δ (260) of more than 0.035. or they have a tan δ (260) of not more than 0.035, but a tan δ (30) of more than 0.005.

Thirdly, the stretchable PMIA fibers of this invention have an average denier size of 50 to 50,000 denier [requirement (C)]. It is not impossible to produce PMIA fibers having a denier size of 50 denier but near 50 denier by the solution method, but the fibers obtained by the solution method do not have the other excellent advantages intended by this invention. Fibers having a size of more than 50,000 denier are too large, and cannot effectively exhibit the characteristic features of the present invention. Such fibers rather fall into the category of the rod-like shaped article. It is not impossible to produce such rod-like shaped articles by compression molding or the like.

Fourthly, the stretchable PMIA fiber of this invention has a maximum heat shrinkage under a fixed load, defined by the following formula (I), of at least 30% when stretched to two times at the glass transition temperature of the wholly aromatic polyamide [requirement (D)].

$$S^o(\%) = \frac{L_o^o - L_p^o}{L_o^o} \times 100 \quad \text{(I)}$$

wherein S° is the maximum heat shrinkage (%) under a fixed load, $L_o^o$ is the length of the sample fiber stretched as above at room temperature, and $L_p^o$ is the length of the stretched sample fiber measured when its shrinkage which occurs when it is placed under a fixed load of 5 mg per denier and heated from room temperature at a rate of 2° C./min. is maximum.

The fourth requirement above of the PMIA fibers of this invention has close correlation to the fifth requirement that the fiber is substantailly amorphous (E).

Figure 7:
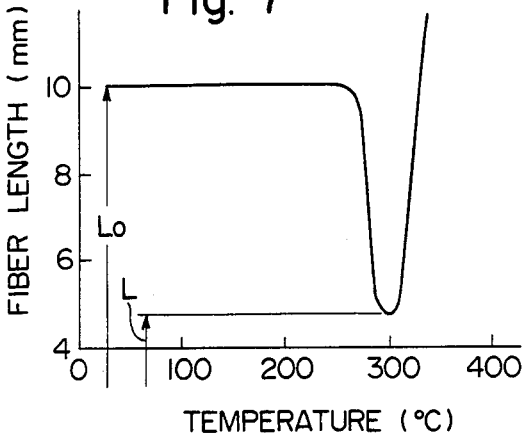
FIG. 7 is a graph depicting the relationship between fiber length and temperature.

FIG. 7 of the accompanying drawings show the relation between the fiber length and the temperature when the stretchable PMIA fiber of this invention is treated by the testing method defining formula (I) above. In the example shown in FIG. 7, when the stretchable PMIA fibers are stretched to 2 times at the glass transition temperature of PMIA, maximum shrinkage occurs at about 300° C. and at this time, the fibers show a shrinkage (S°) of more than 50%.

The fact that the PMIA fibers of this invention are substantially amorphous can be ascertained by the broad angle X-ray diffraction method. The "substantial amorphousness", as referred to in this invention, means that the fibers have crystallinity, measured by X-ray diffractometry, of not more than 10%. In many cases, hardly any analysis peak appears in the X-ray diffraction pattern of the PMIA fibers of this invention, and it is difficult to calculate their crystallinity. Evidently, therefore, the fibers of this invention have a crystallinity of not more than 10%.

The stretchable PMIA fibers of this invention further have the following marked characteristics in addition to the aforesaid characteristic features (A) to (E) which define them.

Another important feature of the PMIA fibers of this invention is that they have a coefficient of variation of a section perpendicular to the longitudinal direction of the fibers [to be simply referred to as a coefficient of sectional variation (CV) hereinafter] of at most 0.05. The coefficient of sectional variation (CV) is a measure of variation in the denier size of the fiber in its longitudinal direction, i.e. denier unevenness.

The PMIA fibers of this invention may be in the form of very long monofilaments, a bundle of monofilaments, or such a bundle cut to a fixed length.

The coefficient of sectional variation in this invention can be determined by selecting a filament (i) having a length of 3 cm from the aforesaid fibers in various forms, cutting it crosswise at 1 mm intervals, measuring the individual cross-sectional areas, calculating the average ($\overline{A}i$) of the 30 cross-sectional areas and the standard deviation ($\sigma i$), and calculating the variation coefficient of the filament (i), CVi, in accordance with the following equation.

$$CVi = \sigma i / \overline{A}i$$

Likewise, ten arbitrary filaments are selected, and the coefficient of sectional variations, CV, is determined in accordance with the following equation in accordance with the following formula.

$$CV = \frac{\sum_{i=1}^{10} (CVi)}{10}$$

The coefficient of sectional variation (CV) of the PMIA fibers of this invention so determined is preferably 0.05 at most, more preferably 0.01 at most. PMIA fibers of such a low coefficient of sectional variation cannot be produced by the process disclosed in U.S. Pat. No. 4,399,084 and European Laid-Open patent publication No. 0047091 previously proposed by the present inventor and his coworkers. It has now been found that such fibers can be produced by the process of this invention. The main reason for this is that the process of this invention obviates the need for taking measures against the thermal decomposition of the polymer in the spinneret. As a result, the thickness of the spinneret can be increased, and there can be used an orifice plate or a nozzle which is precision-worked by most properly designing the inlet angle or the land length. Furthermore, the PMIA filaments extruded from the orifices can be drafted slowly and smoothly in the heat keeping zone.

The PMIA fibers of this invention further have a circle coefficient represented by the following formula of preferably at least 0.9, more preferably at least 0.95.

$$f = \frac{\sum_{i=1}^{10} fj}{10}$$

wherein f is the circle coefficient, and fj is the value $Aj/\pi(d/2)^2$ calculated from the cross-sectional area (Aj) and the diameter (d) of a circumscribing circle with regard to ten sections of a filament taken in its longitudinal direction.

The circle coefficient is determined by selecting an arbitrary filament from an assembly of PMIA filaments as in the case of determining the coefficient of sectional vairations, measuring its cross-sectional area (Ai) and the diameter (d) of a circle circumscribing about it, and calculating the circle coefficient (fj) of its section (j) in accordance with the following formula.

$$fj = Aj/\pi(d/2)^2$$

Likewise, 10 arbitrary sections are selected, and the circle coefficient (f) of the PMIA fibers is calculated in accordance with the above formula.

Fibers having a high circularity with a circle coefficient (f) of at least 0.90 can be produced for the first time by the process of this invention in which PMIA is extruded at the softening temperature (Ts, ° C.). This is partly for the same reason as that given to the achievement of a sectional variation coefficient of not more than 0.05. In addition, since the softened PMIA extruded from a precision-worked orifice having a high circularity has a very high viscosity, it hardly undergoes the effects of gravity or atmospheric air and the extruded PMIA is solidified under a draft while maintaining its high circularity.

The stretched PMIA fibers of this invention, like the stretchable PMIA fibers of the invention, are composed of a wholly aromatic polyamide containing at least 85%, based on the entire recurring units, of m-phenylene isophthlamide units (requirement A'); do not substantially contain an aprotic polar solvent (requirement B'); and are substantially amorphous (requirement E'). They have an average denier size of 20 to 20,000 (requirement C'), and a maximum heat shrinkage under a fixed load of at least 20% (requirement D'). They also have the same sectional variation coefficient (CV), circle coefficient (f), tan δ (30) and tan δ (260) as the strechable PMIA fibers of the invention.

Preferably, the stretched PMIA fiber of this invention has a silk factor (SF), defined by the following formula $$SF = St \times \sqrt{El}$$

wherein St is the tenacity (g/de) of the wholly aromatic polyamide fiber and El is its elongation (%), of at least 10.

By the process of this invention, it is easy to produce stretched fibers with a silk factor (SF) of at least 10 because even when the fibers are stretched to at least 1.2 times, their elongation does not appreciably decrease. The PMIA fibers which the present inventor and his coworkers previously proposed as stated above do not have so high a silk factor because when stretched they have a decreased elongation. It has been found surprisingly in accordance with this invention that the stretched PMIA fibers frequently have a higher elongation than the unstretched fibers.

As an extension of this invention, there are also provided composite fibers composed of a wholly aromatic polyamide polymer layer containing fine inorganic pieces and a wholly aromatic polyamide polymer layer not containing fine inorganic pieces, the two layers being laid side by side.

The composite fibers provided by this invention are a stretchable wholly aromatic polyamide composite fiber characterized in that (a) it consists composd of (1) a first polymer layer composed of a wholly aromatic polyamide containing at least 85%, based on the entire recurring units, of m-phenylene isophthalamide units and (2) a second polymer layer composed mainly of a mixture of a wholly aromatic polyamide containing at least 85 mole %, based on the entire recurring units, of m-phenylene isophthalamide units and fine inorganic pieces, (b) the first polymer layer and the second polymer layer are laid side by side, (c) it does not substantially contain an aprotic polar solvent, (d) it has an average cross-sectional area of 0.0. to 10 $mm^2$, (e) it has a maximum heat shrinkage under a fixed load, as defined by formula (I) above, of at least 20% (the denier size defining $L^o_p$ is the denier size of the polymer component alone excluding the fine inorganic pieces) when stretched to 1.5 times at the glass transition temperature of the wholly aromatic polyamide, and (f) the polymer of the first polymer layer and the polymer of the second polymer layer are both substantially amorphous.

There are also provided stretched wholly aromatic polyamide composite fibers having the above characteristics (a), (b), (d) and (f) given above and (e') below instead of (e).

(e') The fiber has a maximum heat shrinkage under a fixed load defined by formula (II) of at least 10% (the denier size defining $L_p$ is the denier size of the polymer component alone excluding the fine inorganic pieces).

The above composite fibers can be produced by the process described above for producing the PMIA fibers not containing fine inorganic pieces by preparing a laminated shaped article composed of a polymer layer having a wholly aromatic polyamide containing at least 85 mole %, based on the entire recurring units, of m-phenylene isophthalamide units as a main component and a polymer layer composed mainly of a mixture of a wholly aromatic polyamide containing at least 85 mole %, based on the entire recurring units, of m-phenylene isophthalamide units and fine inorganic pieces in the first step instead of preparing a homogeneous shaped article composed of a wholly aromatic polyamide containing at least 85 mole %, based on the entire recurring units, of m-phenylene isophthalamide units as a main component.

Examples of the fine inorganic pieces used in this invention are calcium carbide, titanium oxide, kaolin, clay, talc, diatomaceous earth, potassium titanate, feldspar, mica, glass powder, graphite, carbon black, molybdenum disulfide, metal powders (such as copper powder, aluminum powder, iron powder, chromium powder, nickel powder), gamma-$Fe_2O_3$, silicon carbide, alumina, zeolite, and ceramic materials for sintering. The fine inorganic pieces are selected according to the purpose for which the final fibers of the invention are used. For example, for use in polishing brushes, fine inorganic pieces having a high hardness such as silicon carbide or fused alumina are preferred.

The fine inorganic pieces used in this invention may be spherical, polygonal, acicular, or irregularly shaped. Preferably, they have such a particle size that they pass at least a 20-mesh seive, more preferably a 500 mesh sieve. Particles which are apparently large but are pulverized to the above mesh size in the step of mixing with the aromatic polyamide powder may be used. The smallest particle size of the fine inorganic pieces is usually about 50,000 mesh.

Fine inorganic pieces which are slender, for example, in the form of needles (those having an aspect ratio of at least about 5) have a minimum sectional area of 1 $mm^2$ to $2.5\times10^{-7}$ $mm^2$, preferably $2.5\times10^{-3}$ $mm^2$ to $2.5\times10^{-7}$, and a maximum length of 5 mm to 0.0005 mm, preferably 0.25 mm to 0.0005 mm.

Figure 8:
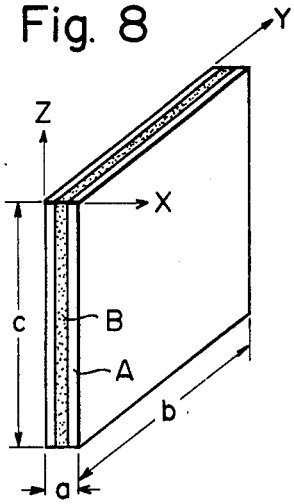
FIG. 8 is a perspective view of one embodiment of the composite shaped articles used in this invention.
Figure 9:
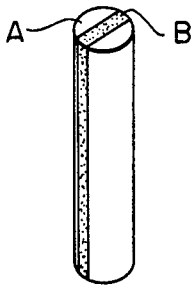
FIG. 9 is a perspective view of one embodiment of the cylindrical composite shaped articles.

The composite shaped article may be plate-like as shown in FIG. 8 or cylindrical as shown in FIG. 9.

The plate-like composite shaped article shown in FIG. 8 can be produced as follows by a compression molding machine as shown in FIG. 2. PMIA powder (A) and a mixture (B) of PMIA powder and fine inorganic pieces are used as starting materials. Preferably, these powders are preheated to about 200° C. In the desired proportions, a first component A (A-1) is first fed into the compression molding machine with an open top as a result of sliding the upper heating plate 2 toward the back of the sheet of FIG. 2. Then, component B and then a second component A (A-2) are sucessively fed. The heating plate 2 is then caused to slide toward the surface of the sheet in FIG. 2 to close the machine. Thereafter, the same operation as in the production of the shaped article in FIG. 1 is carried out.

The resulting shaped article has such a shape that it has a uniform section in at least one direction (Z-direction in FIG. 8), and in this uniform section, the layer A and the layer B are positioned side by side.

FIG. 9 shows a cylindrical composite shaped article.

Figure 10:
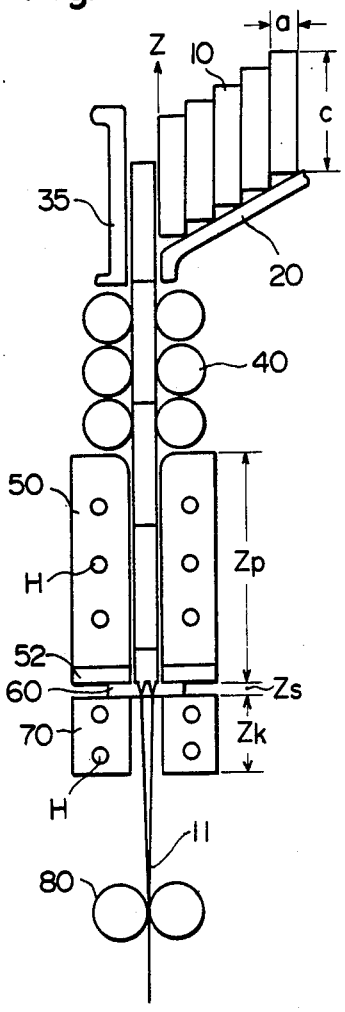
FIG. 10 is a schematic view of a spinning apparatus for carrying out the process of the present invention to spin the above composite shaped articles.

FIG. 10 shows a spinning apparatus which can be applied to the spinning of not only the composite shaped article but also the homogeneous shaped article not containing fine inorganic pieces. With reference to FIG. 10, the process of producing the composite fibers of this invention from the cpmposite plate-like shaped article shown in FIG. 8 will be described.

A plurality of shaped articles 10 are aligned on a sliding stand 20 with the perpendicular direction (Z-direction) of their predetermined uniform section directed upwardly. They are fed successively downwardly along a guide wall 35 and reach a group of stuffing rollers (three sets of a pair of roller in the drawing). They are then forcibly stuffed into a pre-heating zone (Zp) while being held between the rollers. The pre-heating zone should have a passage through which the shaped article 10 can move in the perpendicular direction (Z-direction) of the predetermined uniform section of the shaped article while substantially retaining its form. In the apparatus of FIG. 10, the passage is formed of a pre-heating box 50 having a symmetrical sectional space which is slightly larger than the predetermined uniform section (a x b) of the shaped article. Heaters H are embedded in the wall of the pre-heating box, and the temperature of the passage is accurately controlled.

This passage need not always to be box-shaped as shown in FIG. 10. It is only necessary for the passage to permit accurate movement of the shaped articles within the pre-heating zone always through a fixed path. For example, the inside wall of the box-like pre-heating zone may be corrugated.

In the pre-heating zone constructed of such a pre-heating box 50, the composite shaped article is moved to the end portion of the pre-heating zone (Zp) while being gradually pre-heated to the pre-heating temperature (Tp, ° C.) not exceeding a temperature 20° C. higher than the glass transition point (Tg, ° C.) of PMIA.

The shaped article pre-heated to the pre-heating temperature Tp is then forced into a softening zone (Zs) of a heated spinneret. The softening zone is a softening and extruding section having a length of at least 3 mm having an attenuating passage constructed of orifices at least at its end portion.

Preferably, a heat insulator 52 is provided in the boundary between the pre-heating zone Zp and the softening zone Zs.

The softening zone serves firstly to heat the pre-heated PMIA shaped article rapidly to a uniform softening temperature Ts; secondly to convert many discontinuous PMIA shaped articles into a single continuous softened article by imparting fine shear deformation or elongation deformation to the inside of the softened PMIA shaped articles and bringing the molecules into intimate contact with each other, and thirdly to extrude the continuous softened article uniformly from the orifices.

Figure 11:
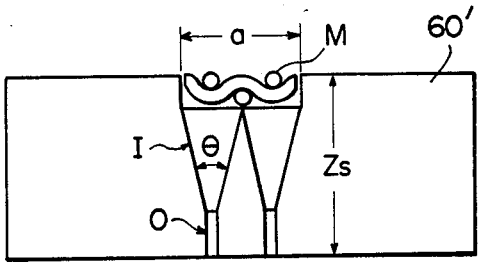
FIG. 11 is a schematic sectional view of a softening zone in which an electrically heated wire mesh M is provided.

In order for the softening zone to act effectively in the manner described above, the shaped article pre-heated in the pre-heaing zone to Tp reaches a softening zone in which an electrically heated wire mesh M is provided at its inlet as shown in FIG. 11.

An electric current for generating Joule's heat which is necessary and sufficient for rapidly heating the PMIA shaped article from Tp to Ts, i.e. the softening temperature ($Tg+40°$ C.$\leqq Ts \leqq Tm-20°$ C.), flows through the wire mesh in a direction perpendicular to the sheet surface in FIG. 11. Since the width a of this wire mesh is made substantially equal to the thickness a of the shaped article, the Joule's heat generated can be very effectively consumed. Immediately below the wire mesh, an inlet I and orifices O are provided in an orifice plate C composed of electrically insulating ceramics. PMIA softened to Ts are extruded from the orifice openings through these attenuating passages.

The second function of the softening zone is performed mainly while the polymer layers pass through the attenuating passages, for example through the openings of the wire mesh, the inlet portion, the land portion of orifices, etc.

The third function is performed by the relatively small inlet angle $\theta$(5°–45°) and the L/D (1–5) of the relatively long orifice land and the non-tackifying finish of the surface of the inlet and the land for the uniform temperature of PMIA attributed to kneading by the second function, and the prevention of melt fracture. For the second and third functions, the softening zone should have a length Zs of at least 3 mm, preferably 5 to 20 mm. If the Zs is shorter than 3 mm, the adjoining portions of the shaped articles will be broken by drafting when extruded from the orifices.

The PMIA softened in the softening zone is extruded from the orifices into a heat keeping zone having a length Zk and surrounded by a thermally insulating wall 70, and forcibly taken up at a draft ratio of at least 1.2 by take-up rollers 80.

Thus, the composite fibers of this invention containing fine inroganic pieces are produced. These composite fibers are stretchable and give the stretched composite fibers of this invention by stretching.

Figure 12:
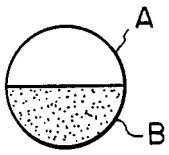
FIGS. 12, 13 and 14 are schematic sectional views of the composite fibers (bristle) of this invention.
Figure 13:
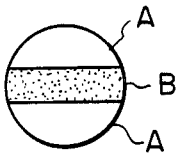
Figure 14:
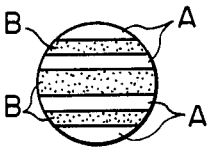

The composite fibers of this invention assume a composite structure in which in a fiber section taken perpendicularly to the longitudinal direction of the fibers, the polymer layer composed mainly of PMIA (layer A) and the layer composed of a mixture of PMIA and the fine inorganic pieces (layer B) are positioned side by side. FIG. 12 is a schematic sectional view of a bristle showing a typical example of this composite structure. FIGS. 13 and 14 are other examples of the composite structure. Selection of the composite structure depends upon the ultimate usage of the resulting composite fibers. But in many cases, the characteristics of the composite fibers of this invention are conspicuously exhibited when the sandwich structure as in FIG. 13 or the multilayer structure as shown in FIG. 14 are taken.

Figure 15:
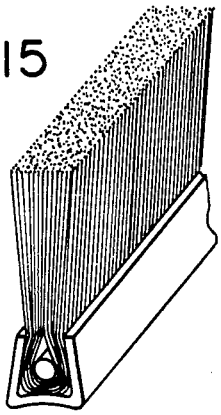
FIG. 15 is a perspective view of a brush according to an embodiment of the use of the bristle of this invention.

The wholly aromatic polyamide fibers and composite fibers provided by this invention are used in various fields requiring heat resistance because of their excellent characteristics described hereinabove. For example, the fibers of this invention are suitably used as bristles of a brush (see FIG. 15) since they have excellent toughness, bending fatigue resistance and elastic recovery. For use in such an application, the composite fibers, above all those having such a structure that as shown in FIG. 13 or 14, a layer composed of a mixture of PMIA and fine pieces of an inorganic material such as alumina or carborundum (layer B) is sandwiched between polymer layers (layers A) composed of PMIA are preferred.

One adavantage of fibers for polishing having such a structure is that since the extent of surface exposure of the inorganic layer is small, dropping of a polishing agent (fine inorganic pieces) from the surfaces of the fibers which are not directly involved in the polishing action is very little. This effect is advantageous not only during use of the fibers as a polishing brush but also during packaging and transportion of the fibrous product.

Another advantage of the composite fibers of this invention in which layers A and B are positioned side by side is that they have higher tensile strength and bending durability than a simple random mixture of PMIA and fine inorganic pieces. Since the wholly aromatic polyamide has a hard skeleton in its molecular structure, fibers from it generally tend to be hard and brittle. When the fine inorganic pieces are mixed randomly with such PMIA, this tendency increases and the fibers will be easily broken even under a relatively low external strain. The simple random structure is very liable to break in the case of the fibers of this invention which have a sectional area of as large as 0.01 $mm^2$ to 10 $mm^2$ because a strain under bending on the surface portions of the fibers is considerably high. This phenomenon increases with increasing proportion of the fine inorganic pieces.

However, in the fibers of this invention having the sandwich structure shown in FIG. 13, bending by natural buckling occurs in a direction at right angles to the boundary line between the layers A and B (the direction in which the flexural rigidity EI is lowest). Hence, a strain generated in layer B which exists in the central portion of the fiber and is thin is very low, and the fibers are difficult of breaking.

The total number of the polymer layers (layers A) and the inorganic layers (layers B) in the composite fibers of this invention is desirably 3 as shown in FIG. 13 from the viewpoint of flexural durability. When another function of the fibers is important, it is sometimes useful to provide 2 or 4 layers in total. For example, when it is desired to expose the inorganic layer (layer B) on the surface of the fibers, the provision of 2 layers is effective. When it is desired to impart an electrical or magnetic function to the fibers, the provision of about 7 layers as shown in FIG. 14 has been found to be useful. If the number of the layers is increased too much, the molding of the shaped article becomes complex, and if 10 or more layers are provided, there is a limit to the effect of providing multiple layers.

The proportion of the fine inorganic pieces in layer B of the composite fibers of this invention can be changed as desired. For polishing applications, the characteristics of the composite fibers of this invention are exhibited to a greater extent when the proportion of the fine inorganic pieces is 90 to 95% by weight. Such a high mixing proportion can be used for the first time by the process of this invention.

According to the process of this invention, the ratio of the area of layer A to that of layer B in a fiber section taken perpendicularly to the longitudinal direction of the composite fibers can be varied as desired. The characteristics of the composite fibers of this invention are advantageously exhibited when this area ratio is in the range of from 20:80 to 95:5.

The following examples illustrate the present invention more specifically.

EXAMPLE 1

Porous aggregated particles of poly(m-phenylene isophthalamide) obtained by polymerizing m-phenylenediamine and isophthaloyl chloride on the interface of tetrahydrofuran and water and having an average particle diameter of 50 micrometers and an inherent viscosity, measured in N-methylpyrrolidone, of 1.35) were used as a starting material. The PMIA particles had a glass transition point Tg, measured by a differential scanning calorimeter, 277° C. By measuring the melting point Tm of the fibers obtained as shown below, it was confirmed that the melting point of PMIA was 423° C.

The PMIA particles were compression-molded at 320° C. under 100 $kg/cm^2$ by using the compression-molding apparatus shown in FIG. 3 to produce many plate-like shaped articles (a=8 mm, b=100 mm, c=100 mm, porosity=0.1%) as shown in FIG. 1.

An assembly of bristles of the PMIA were produced from the resulting shaped articles under the conditions shown in Table 1 by the apparatus shown in FIG. 4. The properties of the PMIA fibers were measured, and found to be very satisfactory as shown in Table 2.

TABLE 1

| Zone | Item | Conditions |
|---|---|---|
| Stuffing | Speed ($V_o$) | 20 mm/min. |
| Preheating | Temperature (Tp) | Tg − 22° C. = 255° C. |
| | Length (Zp) | 400 mm |
| Softening | Temperature (Ts) | Tg + 68° C. = Tm − 78° C. = 345° C. |
| | Length (Zs) | 10 mm |
| | Orifice diameter (d) | 1 mm |
| | Number of orifices (n) | 40 |
| Heat keeping (take-up) | Temperature (Tk) | Tg + 68° C. = Tm − 78° C. = 345° C. |
| | Length (Zk) | 70 mm |
| | Extrusion speed (Vs) | 510 mm/min. |
| | Take-up speed (Ve) | 4000 mm/min. |
| | Draft ratio (Dr) | Ve/Vs = 7.84 |
| Stretching | Ratio (DR) | 2.0 |
| | Temperature | (Tg + 8) = 285° C. |

TABLE 2

| Item | Result |
|---|---|
| Average denier size | 610 denier |
| Residual solvent | not detected (less than 10 ppm) |
| Coefficient of sectional variation (CV) | 0.03 |
| Maximum heat shrinkage (S) | 52% |
| Silk factor (SF) | $3.2 \times \sqrt{22} = 15.0$ |

EXAMPLE 2

A number of plate-like shaped articles (a=8 mm, b=100 mm, c=100 mm, porosity=0.3%) were produced from porous aggregated particles (average particle diameter 70 micrometers) of poly(m-phenylene isophthalamide.terephthalamide) (the mole ratio of isophthalamide to terephthalimide=97/6) obtained by the same interfacial polymerization technique as in Example 1 and having an intrinsic viscosity of 1.37. The PMIA particles had a glass transition temperature Tg, measured by a diffrential scanning calorimeter, of 273° C. The melting point Tm of the PMIA particles were determined to be 420° C. by measuring the melting point of the unstretched fibers (obtained therefrom by the following method) by a differential scanning calorimeter.

The shaped articles were used as a starting material, and spun and stretched by the apparatus shown in FIG. 4 under the conditions shown in Table 3.

The properties of the resulting fibers were measured, and the results are shown in Table 4.

TABLE 3

| Zone | Item | Conditions |
|---|---|---|
| Stuffing | Speed ($V_o$) | 10 mm/min. |
| Preheating | Temperature (Tp) | Tg − 23° C. = 250° C. |
| | Length (Zp) | 400 mm |
| Softening | Temperature (Ts) | Tg + 97° C. = Tm − 50° C. = 370° C. |
| | Length (Zs) | 12 mm |
| | Orifice diameter (d) | 1 mm |
| | Number of orifices (n) | 50 |
| | Degree of attenuation (α) | 0.049 |
| Heat keeping (take-up) | Temperature (Tk) | Tg + 47° C. = Tm − 100° C. = 320° C. |
| | Length (Zk) | 40 mm |
| | Extrusion speed (Vs) | 204 mm/min. |
| | Take-up speed (Ve) | 775 mm/min. |
| | Draft ratio (Dr) | Ve/Vs = 3.8 |
| Stretching | Ratio (DR) | 2.5 |
| | Temperature | (Tg + 7) = 280° C. |

TABLE 4

| Item | Result |
|---|---|
| Average denier size | 1000 denier |
| Residual solvent | not detected |
| Coefficient of sectional variation (CV) | 0.01 |
| Maximum heat shrinkage (S) | 53% |
| Silk factor (SF) | $2.8 \times \sqrt{30} = 15.3$ |
| X-ray crystallinity | less than 10% |

The resulting bundle of fibers was cut to a length of 40 mm, and a channel brush as shown in FIG. 8 was produced by using the cut fibers as a material. The brush was mounted on a stretch heat-setting roller (surface temperature 240° C.) used in the process of producing polyester staple fibers, and used for removing naps. The brush withstood continuous use over 6 months without breakage, and retained a sufficient nap removing effect.

EXAMPLE 3

Stretched PMIA fibers were produced from the same plate-like shaped articles used in Example 2 by the apparatus shown in FIG. 4 under the conditions indicated in Table 5. The properties of the resulting fibers were measured, and the results are shown in Table 6.

TABLE 5

| Zone | Item | Conditions |
|---|---|---|
| Stuffing | Speed ($V_o$) | 10 mm/min. |
| Preheating | Temperature (Tp) | Tg − 18° C. = 255° C. |
| | Length (Zp) | 400 mm |
| Softening | Temperature (Ts) | Tg + 107° C. = Tm − 40° C. = 380° C. |
| | Length (Zs) | 12 mm |
| | Orifice diameter (d) | 0.5 mm |
| | Number of orifices (n) | 100 |
| | Degree of attenuation (α) | 0.025 |
| Heat keeping (take-up) | Temperature (Tk) | Tg + 77° C. = Tm − 70° C. = 350° C. |
| | Length (Zk) | 60 mm |
| | Extrusion speed (Vs) | 408 mm/min. |
| | Take-up speed (Ve) | 6440 mm/min. |
| | Draft ratio (Dr) | Ve/Vs = 15.8 |
| Stretching | Ratio (DR) | 3.0 |
| | Temperature | (Tg + 12) = 285° C. |

TABLE 6

| Item | Result |
|---|---|
| Average denier size | 50 denier |
| Residual solvent | not detected |
| Coefficient of sectional variation (CV) | 0.03 |
| Maximum heat shrinkage (S) | 68% |
| Silk factor (SF) | $3.5 \times \sqrt{14} = 13.1$ |
| X-ray crystallinity | less than 10% |

The resulting assembly of bristles were divided into four bundles and twisted into filament yarns (1250 de-25 fil). The filament yarns were found to be useful, for example, as a material for heat-resistant fabrics such as canvas, and a pile substrate for flame retardant carpets.

EXAMPLE 4

From the same PMIA as used in Example 1, a number of rod-like shaped articles (diameter 10 mm, length 100 mm, porosity 0.05%) as shown in FIG. 2 were produced by compression molding. The shaped articles were used as a starting material, and a PMI monofilament was produced by the apparatus shown in FIG. 6 under the conditions shown in Table 7.

The properties of the monofilament were measured, and the results were very satisfactory as shown in Table 8.

TABLE 7

| Zone | Item | Conditions |
|---|---|---|
| Stuffing | Speed ($V_o$) | 30 mm/min. |
| Preheating | Temperature (Tp) | Tg − 17° C. = 260° C. |
| | Length (Zp) | 300 mm |
| Softening | Temperature (Ts) | Tg + 73° C. = Tm − 73° C. = 350° C. |
| | Length (Zs) | 30 mm |
| | Orifice diameter (d) | 2 mm |
| Heat keeping (take-up) | Temperature (Tk) | Tg + 68° C. = Tm − 78° C. = 345° C. |
| | Length (Zk) | 50 mm |
| | Extrusion speed (Vs) | 750 mm/min. |
| | Take-up speed (Ve) | 8000 mm/min. |
| | Draft ratio (Dr) | Ve/Vs = 10.7 |
| Stretching | Ratio (DR) | 2.2 |
| | Temperature | (Tg + 10) = 287° C. |

TABLE 8

| Item | Result |
|---|---|
| Average denier size | 1620 denier |
| Residual solvent | not detected (less than 10 ppm) |
| Coefficient of sectional variation (CV) | 0.02 |
| Maximum heat shrinkage (S) | 57% |
| Silk factor (SF) | $3.4 \times \sqrt{28} = 18.0$ |

EXAMPLE 5

A PMIA monofilament was produed in the same manner as in Example 1 under the conditions indicated in Table 9. The properties of the resulting monofilament are shown in Table 10.

TABLE 9

| Zone | Item | Conditions |
|---|---|---|
| Stuffing | Speed ($V_o$) | 20 mm/min. |

TABLE 9-continued

| Zone | Item | Conditions |
|---|---|---|
| Preheating | Temperature (Tp) | Tg − 22° C. = 255° C. |
| | Length (Zp) | 300 mm |
| Softening | Temperature (Ts) | Tg + 73° C. = Tm − 73° C. = 350° C. |
| | Length (Zs) | 30 mm |
| | Orifice diameter (d) | 3 mm |
| | Degree of attenuation (α) | 0.09 |
| Heat keeping (take-up) | Temperature (Tk) | Tg + 53° C. = Tm − 93° C. = 330° C. |
| | Length (Zk) | 50 mm |
| | Extrusion speed (Vs) | 222 mm/min. |
| | Take-up speed (Ve) | 444 mm/min. |
| | Draft ratio (Dr) | Ve/Vs = 3.0 |
| Stretching | Ratio (DR) | 2.0 |
| | Temperature | (Tg + 10) = 287° C. |

TABLE 10

| Item | Result |
|---|---|
| Average denier size | 1700 denier |
| Residual solvent | not detected |
| Coefficient of sectional variation (CV) | 0.03 |
| Maximum heat shrinkage (S) | 44% |
| Silk factor (SF) | $2.2 \times \sqrt{25} = 11$ |
| X-ray crystallinity | less than 10% |

The monofilament had a circle coefficient (obtained by dividing the cross-sectional area of the monofilament by the area of a circle circumscribing the cross-section of the monofilament) of at least 0.98 and its circularity is very high. Because of the self-lubricating properties of PMIA, the resulting monofilament could be applied to various small-sized machine parts.

EXAMPLE 6

The same PMIA particles as used in Example 1 (component A) and a mixture of the same PMIA particles and 60% of white alumina having an average particle diameter of 34 micrometers (a product of Fujimi Abrasive Material Industry Co., Ltd.) (component B) were used as starting materials. By using the compression molding machine shown in FIG. 3, 40 g of each of two components A and 35 g of component B were molded in a sandwich structure composed of A-B-A at 320° C. under 100 kg/cm$^2$ to produce many plate-like composite shaped articles as shown in FIG. 1 (a=8 mm, b=c=100 mm, porosity=0.1%).

Composite fibers were produced from the composite shaped articles by using the apparatus shown in FIG. 4 under the conditions shown in Table 11.

The properties of the composite fibers were measured, and the results are shown in Table 12.

A roller brush was produced by using the resulting composite fibers as bristles, and tested as an abrasive brush for steel-making. Since its heat resistance was greatly improved over a conventional abrasive brush (composed of bristles from a mixture of nylon and an abrasive material), means for cooling the brush, for example, by water cooling became unnecessary, and the use of the brush so produced contributed greatly to the curtailment of the cost in the steel-making process.

TABLE 11

| Zone | Item | Conditions |
|---|---|---|
| Stuffing | Speed ($V_o$) | 10 mm/min. |
| Preheating | Temperature (Tp) | Tg − 17° C. = 260° C. |
| | Length (Zp) | 400 mm |
| Softening | Spinneret temperature | 400° C. |
| | Temperature (Ts) | Tg + 88° C. = Tm − 58° C. = 365° C. |
| | Length (Zs) | 10 mm |
| | Orifice diameter (d) | 2.0 mm |
| | Number of orifices (n) | 40 |
| Heat keeping (take-up) | Temperature (Tk) | Tg + 68° C. = Tm − 78° C. = 355° C. |
| | Length (Zk) | 30 mm |
| | Extrusion speed (Vs) | 63.7 mm/min. |
| | Take-up speed (Ve) | 382 mm/min. |
| | Draft ratio (Dr) | Ve/Vs = 6 |
| Stretching | Ratio (DR) | 1.5 |
| | Temperature | 280° C. |

TABLE 12

| Item | Result |
|---|---|
| Average sectional area | 0.35 mm$^2$ |
| Ratio of the cross-sectional area of layer A to that of layer B | 68:32 |
| Proportion of alumina in layer | 60% |
| Strength | 16 kg/mm$^2$ |
| Elongation | 10% |
| Maximum heat shrinkage (S) | 23% |

EXAMPLE 7

The same PMIA particles as used in Example 1 (component A) and a random mixture of the same PMIA particles and 70% of strontium ferrite havign an average particle diameter of 20 micrometers (component B) were used as starting materials. By using the compression molding machine shown in FIG. 3, 20 g of each of two components A and 15 g of each components B were molded in a 7-layer structure with outside layers of component A to produce many plate-like compositer shaped articles.

Composite fibers were produced from the composite shaped articles by using the apparatus shown in FIG. 10 under the conditions shown in Table 13.

The cross-sectional shape of each of the resulting fibers was as shown in Table 14. The properties of the composite fibers were measured, and the results are shown in Table 14.

Magnetic bristles were produced by magnetizing the resulting fibers so that an N-pole and an S-pole polarized in a direction parallel to the layers A and B. These magnetic bristles had better dynamical properties than those obtained from a random mixture of the PMIA particles and strontium ferrite. In addition, presumably because of the effect of strontium ferrite to increase density, the magnetic bristles obtained in accordance with this example showed stronger magnetism than the latter.

TABLE 13

| Zone | Item | Conditions |
|---|---|---|
| Stuffing | Speed ($V_o$) | 15 mm/min. |
| Preheating | Temperature (Tp) | 255° C. |
| | Length (Zp) | 400 mm |
| Softening | Spinneret temperature | 410° C. |
| | Softening Temperature (Ts) | 360° C. |
| | Length (Zs) | 15 mm |
| | Orifice diameter (d) | 3.0 mm |
| | Number of orifices (n) | 25 |

TABLE 13-continued

| Zone | Item | Conditions |
|---|---|---|
| Heat keeping (take-up) | Temperature (Tk) | 320° C. |
| | Length (Zk) | 30 mm |
| | Extrusion speed (Vs) | 68 mm/min. |
| | Take-up speed (Ve) | 340 mm/min. |
| | Draft ratio (Dr) | 5 |
| Stretching | Ratio (DR) | 1.4 |
| | Temperature | 290° C. |

TABLE 14

| Item | Result |
|---|---|
| Average sectional area | 1.0 $mm^2$ |
| Ratio of the cross-sectional area of layer A to that of layer B | 50:50 |
| Proportion of strontium ferrite in layer B | 70% |
| Strength | 12 $kg/mm^2$ |
| Elongation | 9% |
| Maximum heat shrinkage (S) | 25% |

What is claimed is:

1. A stretchable wholly aromatic polyamide fiber which:

(A) is composed of a wholly aromatic polyamide containing at least 85 mole %, based on the entire recurring units, of m-phenylene isophthalamide units as a main component, (B) does not substantially contain an aprotic polar solvent, (C) has an average denier size of 50 to 50,000, (D) is stretchable to two times at the glass transition temperature of the wholly aromatic polyamide, and the resultant stretched fiber has a maximum heat shrinkage under a fixed load, defined by the following formula (I), of at least 30%, $$S^o(\%) = \frac{L_o^o - L_p^o}{L_o^o} \times 100 \quad \text{(I)}$$

where S° is the maximum heat shrinkage (%) under a fixed load, $L_o$° is the length of the sample fiber stretched as above at room temperature, and $L_p$° is the length of the stretched sample fiber measured when its shrinkage which occurs when it is placed under a fixed load of 5 mg per denier and heated from room temperature at a rate of 2° C./min. is maximum, (E) is substantially amorphous and (F) said wholly aromatic polyamide fiber having a coefficient of sectional variation CV, defined by the following formula $$CV = \frac{\sum_{i=1}^{10} (CVi)}{10}$$

wherein CVi is the value ($\sigma i/\overline{Ai}$) calculated from an average ($\overline{Ai}$) and standard deviation ($\sigma$) of the areas of 30 sections taken in the lognitudinal direction of the fiber, of at most 0.05.

2. The wholly aromatic polyamide fiber of claim 1 which has a circle coefficient f, defined by the following formula $$f = \frac{\sum_{j=1}^{10} fj}{10}$$

wherein fj is the value ($Aj/\pi(d/2)^2$) calculated from the sectional area (Aj) and the diameter (d) of a circle circumscribing about the fiber section with regard to 10 sections of the fiber taken along its length of at least 0.9.

3. The wholly aromatic polyamide fiber of claim 1 which has a loss tangent at 30° C., tan δ (30), and a loss tangent at 260° C., tan δ (260), satisfying the following formulae:

$$\tan \delta(30) \leqq 0.005$$

$$\tan \delta(260) \leqq 0.035.$$

4. A stretched wholly aromatic polyamide fiber which (A) is composed of a wholly armoatic polyamide containing at least 85 mole %, based on the entire recurring units, of m-phenylene isophthalamide units as a main component, (B) does not substantially contain an aprotic polar solvent, (C) has an average denier size of 20 to 20,000, (D) has a maximum heat shrinkage under a fixed load, defined by the following formula (II), of at least 20%, $$S(\%) = \frac{L_o - L_p}{L_o} \times 100 \quad \text{(II)}$$

wherein S is the maximum heat shrinkage (%) under a fixed load, $L_o$ is the length of the sample fiber stretched as above at room temperature, and $L_p$ is the length of the stretched sample fiber measured when its shrinkage which occurs when it is placed under a fixed load of 5 mg per denier and heated from room temperature at a rate of 2° C./min. is maximum, (E) is substantially amorphous and (F) said wholly aromatic polyamide fiber having a coefficient of sectional variation CV, defined by the following formula $$CV = \frac{\sum_{i=1}^{10} (CVi)}{10}$$

wherein CVi is the value ($\sigma i/\overline{Ai}$) calculated from an average ($\overline{Ai}$) and standard deviation ($\sigma$) of the areas of 30 sections taken in the longitudinal direction of the fiber, of at most 0.05.

5. The wholly aromatic polyamide fiber of claim 4 which has a silk factor, SF, defined by the following formula $$SF = St \times \sqrt{El}$$

wherein St is the strength (g/de) of the wholly aromatic polyamide fiber, and El is its elongation (%), of at least 10.

6. The wholly aromatic polyamide fiber of claim 4 which has a circle coefficient f, defined by the following formula $$f = \frac{\sum_{j=1}^{10} fj}{10}$$

wherein fj is the value $(Aj/\pi(d/2)^2)$ calculated from the sectional area (Aj) and the diameter (d) of a circle circumscribing about the fiber section with regard to 10 sections of the fiber taken along its length, of at least 0.9.

7. The wholly aromatic polyamide fiber of claim 4 which has a loss tangent at 30° C., tan δ (30), and a loss tangent at 260° C., tan δ (260), satisfying the following formulae:

$$\tan \delta(30) \leqq 0.005$$

$$\tan \delta(260) \leqq 0.035.$$

8. A brush comprising the wholly aromatic polyamide fiber or composite fiber of claim 1 or 4 as bristles.

* * * * *